US005853149A

United States Patent [19]

Vo et al.

[11] Patent Number: 5,853,149

[45] Date of Patent: Dec. 29, 1998

[54] STRESS-FREE DOME MOUNT MISSILE DESIGN

[75] Inventors: Peter H. Vo; John F. Binnie, Jr., both of Tucson, Ariz.

[73] Assignee: Raytheon Company, Los Angeles, Calif.

[21] Appl. No.: 637,193

[22] Filed: Apr. 8, 1996

[51] Int. Cl.[6] ..... B64C 1/14; B64D 47/08

[52] U.S. Cl. ..... 244/121; 244/3.16; 244/129.3; 244/131; 102/293

[58] Field of Search ..... 244/121, 131, 244/129.3, 3.1, 3.16; 102/293

[56] References Cited

U.S. PATENT DOCUMENTS

| | | | |
|---|---|---|---|
| 3,165,749 | 1/1965 | Cushner | 244/3.16 X |
| 3,674,227 | 7/1972 | Jacobson et al. | 244/121 |
| 3,747,530 | 7/1973 | Tepper | 244/3.16 X |
| 3,757,698 | 9/1973 | Jacobson | 244/131 |
| 4,011,819 | 3/1977 | Kessler | 244/131 |
| 5,129,990 | 7/1992 | Binnie, Jr. et al. | 244/131 X |
| 5,404,814 | 4/1995 | Fisch et al. | 244/3.16 X |

*Primary Examiner*—William Grant
*Attorney, Agent, or Firm*—David W. Collins; Leonard A. Alkov; Glenn H. Lenzen, Jr.

[57] ABSTRACT

A missile having an improved dome mounting arrangement, and a method for mounting a sapphire dome to a titanium missile turret that provides for minimum surface deformation and environmental sealing of the dome. A sealing material such as silicone rubber compound that is capable of enduring high temperatures attained during high speed missile flight is employed. The missile has a body with a nose and the dome mounting arrangement is attached to the nose. The dome mounting arrangement comprises a turret secured to the nose, the dome, and a retainer ring attached to the turret for securing the dome to the turret. An annular gap is formed between an outer surface of the dome and an inner surface of the retainer ring. The silicone rubber compound is disposed in the annular gap and cured to seal the dome. A plurality of shims may be disposed between the dome and the turret in a radial gap formed therebetween. A plurality of shims may also be disposed between the dome and the retaining ring around the periphery of the dome during assembly, so that the dome rotates freely after shimming. This ensures that the dome is stress-free during and after curing of the silicone rubber compound. The shims are removed after the silicone rubber compound no longer flows. The silicone rubber compound is cured for high temperature performance by curing for four hours, minimum, at room temperature, and then curing for two hours, minimum, at 160°±10° F., and then curing at 260°±10° F. for 30 minutes, minimum, and then curing them at 360°±10° F. for 30 minutes, minimum. Finally, the compound is cured at 400°±10° F. for 30 minutes, minimum, and then cooled to room temperature.

13 Claims, 3 Drawing Sheets

STRESS-FREE DOME MOUNT MISSILE DESIGN

BACKGROUND

The present invention relates generally to missiles, and more particularly, to a missile having a stress-free dome mounting arrangement and method of attaching the dome to the missile.

There is no known specific prior art that is displaced or improved upon by the present invention. However, a similar design exists on an I. R. Maverick missile manufactured by the assignee of the present invention, but that is used for a different purpose. In the I. R. Maverick missile application, a zinc sulfide dome is secured to an aluminum nose using silicone rubber, such as is provided by RTV-630 silicone rubber available from General Electric, for example. However, the RTV-630 silicone rubber has a lower temperature capability than that of the RTV used in the present invention. The I. R. Maverick design used the RTV-630 silicone rubber to match a low coefficient of thermal expansion of a zinc sulfide dome to the relatively high coefficient of thermal expansion of an aluminum nose so that the dome would not fracture as a result of mechanical loading exerted by the nose due to operational temperature excursions. The RTV-630 silicone rubber was selected because it has the required tensile strength and elongation properties to satisfy the design requirement. The dome-to-nose joint dimensions were selected to take advantage of the coupling capability of the RTV-630 silicone rubber and to meet the mechanical and structural requirements of the dome/nose assembly.

Therefore, it is an objective of the present invention to provide for a missile having an improved stress-free dome mounting arrangement. It is a further objective of the present invention to provide for a method of attaching a dome to a missile that provides for minimum stress on the dome.

SUMMARY OF THE INVENTION

To meet the above and other objectives, the present invention provides for an improved missile, a dome mounting arrangement, and method that is used to secure an optical dome to a high performance ground-to-air heat seeking missile. More specifically, the present invention is used to mount a single crystal sapphire dome to a titanium missile turret in a manner that minimizes surface deformation of the dome when mounted. The present invention also provides for environmental sealing of the dome to the missile. The present invention uses a silicone rubber compound, such as General Electric RTV-31, for example, that is capable of enduring high temperatures attained during high speed missile flight. The present invention is less expensive than conventional dome attachment techniques.

A missile in accordance with the present invention comprises a missile body 20 having a nose portion disposed at a forward end and a dome mounting arrangement coupled to the nose portion. The dome mounting arrangement of the present invention comprises a turret that is secured to the nose portion of the body, the dome, and a retainer ring. The retainer ring includes an end portion permanently attached to the turret and an opposite end portion extending beyond the turret. The retainer ring further includes an inner wall facing both the turret and an outer wall of the dome when the dome is positioned adjacent the turret. An annular gap is formed between the outer wall of the dome, the turret and the inner wall of the retainer ring. In a similar manner, an axial gap joins the annular gap and extends between an end surface of the turret and a confronting end surface of the dome when the dome is positioned adjacent to the turret. A silicone rubber compound is introduced into the annular gap formed by the side walls of the dome, turret and retaining ring and enters into the connected axial gap formed between the end surfaces of the dome and the turret. The silicone rubber is cured in accordance with the present invention to seal the dome both to the turret and the retainer ring in a unique, stress-free manner.

A plurality of plastic shims may be disposed between the dome and the retaining ring at predetermined locations around the periphery of the dome, so that the dome rotates freely after shimming. This ensures that the dome is stress-free during and after curing of the silicone rubber compound. The shims are removed after the silicone rubber compound has reached a point in its cure wherein it no longer flows.

The silicone rubber compound cures for high temperature performance by first curing for four hours, minimum, at room temperature, then curing for two hours, minimum, at 160°±10° F., followed by curing at 260°±10° F. for 30 minutes, minimum, and then curing at 360°±10° F. for 30 minutes, minimum. Finally, the compound is cured at 400°±10° F. for 30 minutes, minimum, and then cooled to room temperature.

The present dome mounting arrangement provides for minimum surface deformation of the sapphire dome after it is mounted to the titanium turret, thereby maximizing the imaging performance of an optical sensor disposed in the missile. The present dome mounting arrangement also minimizes stress exerted on the dome due to high-speed aeroloading during missile flight as well as provides excellent cushioning of the dome relative to the turret.

The present invention thus provides a means and method for attaching the dome to the turret of the missile in an economic manner while meeting environmental, mechanical and optical performance requirements of the missile. Use of the present invention does not require specialized, high cost, process operations associated with prior manufacturing methods, namely brazed flexure mounting methods. Brazing assembly techniques for sapphire missile dome configurations have not been developed in this country.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
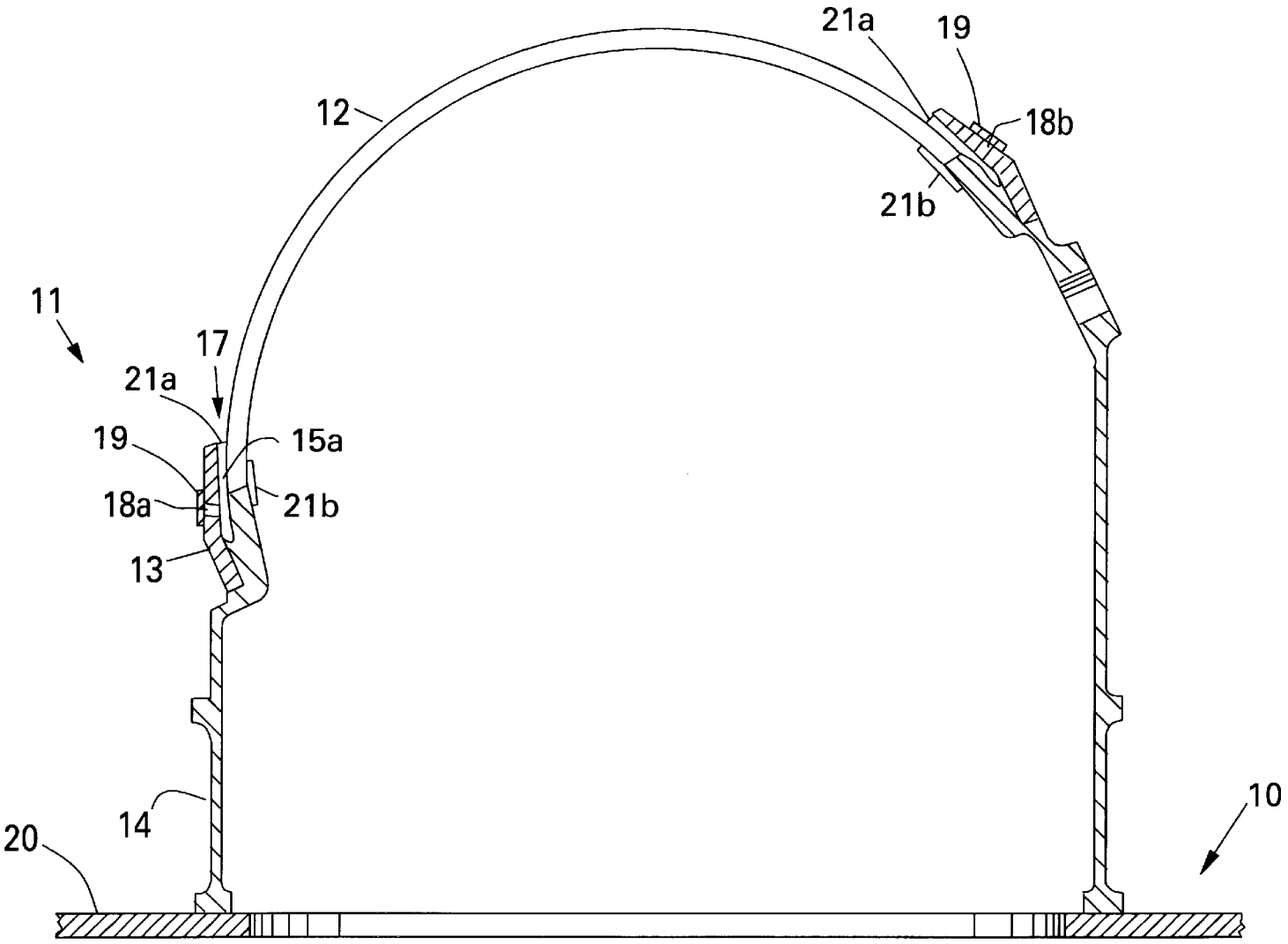
FIG. 1 illustrates a cross sectional view of a portion of a missile having an improved stress-free dome mounting arrangement in accordance with the principles of the present invention.
Figure 1A:
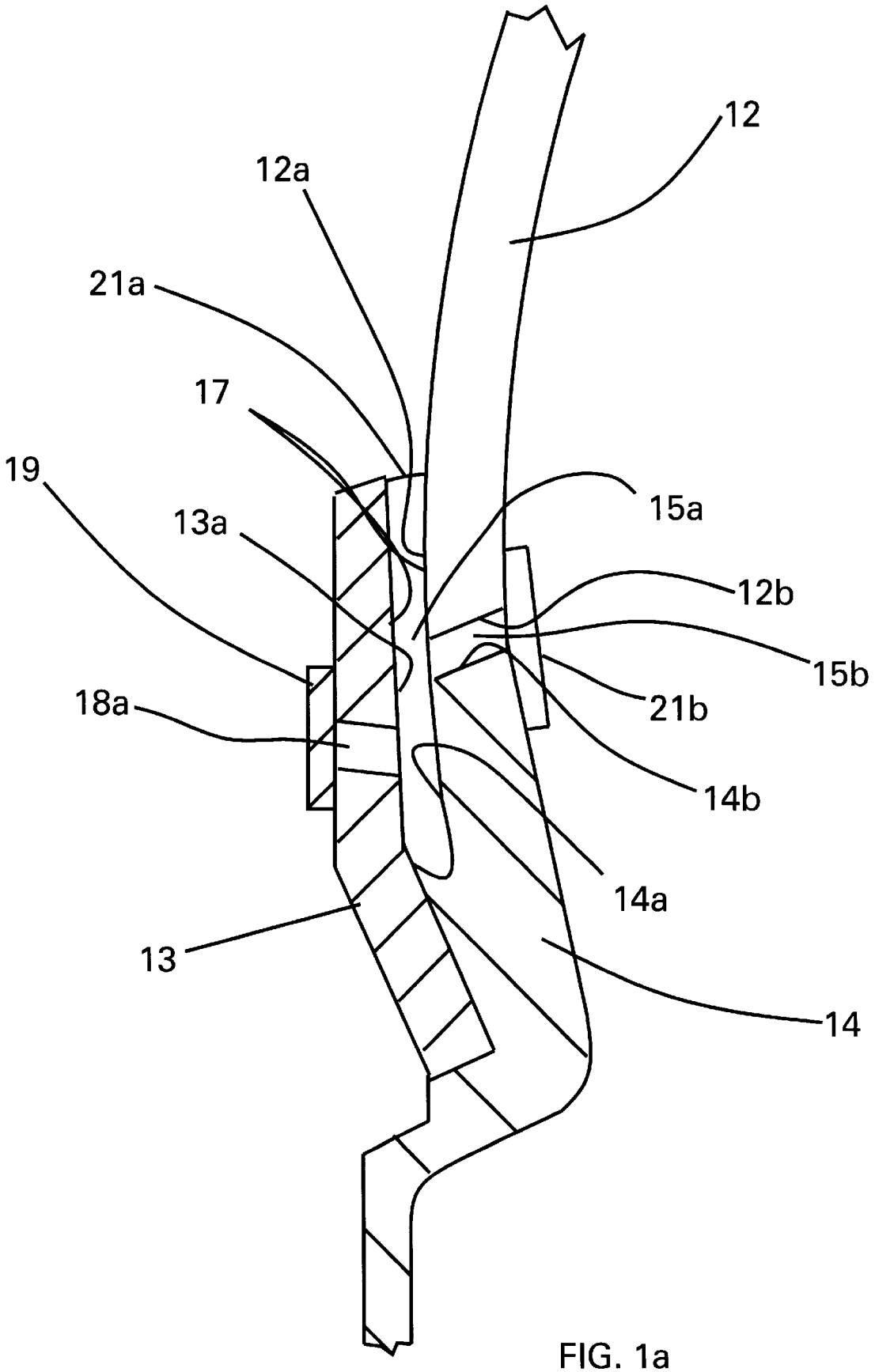
FIG. 1*a* illustrates an encircled portion of the cross sectional view of FIG. 1 enlarged to show the mounting arrangement in detail.

Referring now to the drawings, FIGS. 1 and 1*a* each illustrates a cross sectional view of a portion of a missile 10 having a stress-free dome mounting arrangement 11 constructed in accordance with the principles of the present invention. A method in accordance with the present invention is also described here below. The mounting arrangement 11 (FIG. 2) comprises three main components, including a dome 12, a retainer ring 13, and a turret 14 that is secured to a nose portion 20 of missile 20. The dome 12 preferably comprises a single crystal sapphire. Both the retainer ring 13 and turret 14 are preferably formed of titanium. The retainer ring 13 is preferably permanently attached to the turret 14 by electron beam welding. Other means of attaching the retainer ring 13 to the turret 14 may be also employed such as by using a threaded mechanical attachment, or the two components may be bonded using a high temperature structural polyimide adhesive, or other appropriate adhesive.

Potting surfaces of the dome 12, retainer ring 13 and turret 14 are cleaned with wipers moistened with isopropyl alcohol, for example, and wiped dry with clean, dry wipers. Other cleaning methods may also be used to produce equivalent results. Aqueous cleaning methods may be used followed by a deionized water rinse and subsequent drying, for example. Vapor degreasing techniques using appropriate solvents such as isopropyl alcohol may also be employed. A thin film of primer, such as type SS-4004 primer manufactured by General Electric, for example is then applied to the potting surfaces of the dome 12, retainer ring 13 and turret 14 and allowed to dry for one hour, minimum, at room temperature.

Because of the mounting configuration of the sapphire dome 12, it is loosely entrapped in place prior to permanently attaching the retainer ring 13 to the turret 14. After the retainer ring 13 is attached to the turret 14, an uncured silicone rubber compound 17 or other sealing material flows into and fills an annular gap 15*a* (FIG. 1*a*) formed between the outer wall 12*a* of dome 12 and the inner wall 13*a* of retainer ring 13, and an outer wall 14*a* of turret 14. The silicone rubber compound 17 also flows into and fills axial gap 15*b* connected to gap 15*a* and extending between an end surface 12*b* of dome 12 and a confronting end surface 14*b* of turret 14 (FIG. 1*a*).

Figure 2:
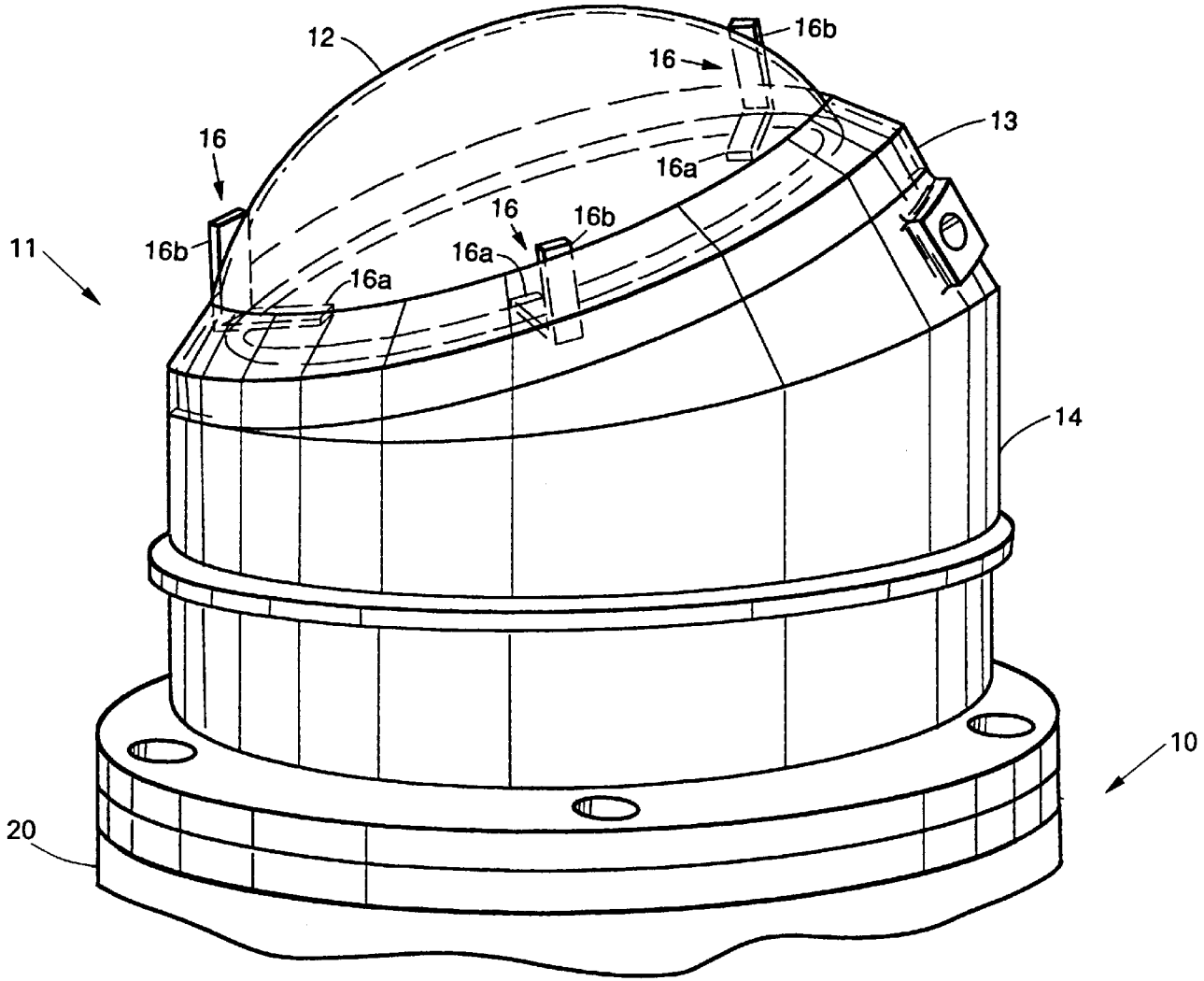
FIG. 2 is a three dimensional view of the missile dome mounting arrangement illustrating dome positioning.

The dome 12 is positioned in place with plastic shims 16 at six locations, three axial locations 16*a* and three radial locations 16*b*, as is shown in FIG. 2. The dome 12 must be allowed to rotate freely after shimming. This ensures that the dome 12 is stress-free during the initial curing time of the silicone rubber compound 17.

The silicone rubber compound 17 may be comprised of RTV-31 that is catalyzed with 0.1–0.5% by weight dibutyl tin dilaurate (such as Thermolite 12) to provide an adequate pot life and reasonable cure time. The mixed compound 17 is vacuum degassed at 25 mm Hg, minimum, to remove air entrapped during the mixing operation.

Red wax 21*a* (FIG. 1*a*) may preferably be employed to seal an end of annular gap 15*a* extending between retainer ring 13 and dome 12, which gap provides a flow-passage for the silicone rubber compound 17. Red wax 21*b* also may preferably be employed to seal an end of axial gap 15*b* remotely located from retaining ring 13. Other techniques may be employed to provide equivalent sealing, as may be desired. A syringe and needle may be used to inject the uncured silicone rubber compound 17 into annular gap 15*a* and axial gap 15*b*. The RTV-31 is injected into gap 15*a* and flows into gap 15*b* between retainer ring 13 and dome 12 by way of an inlet hole 18*a* until both gaps are filled and RTV vents from an exit hole 18*b* in the retainer ring 13. Tape 19 may be applied over inlet hole 18*a* as well as exit hole 18*b*, if desired, to prevent the RTV from leaking prior to curing.

The shims 16, red wax 21*a*, 21*b* and tape 19 are removed after the silicone rubber compound 17 has reached a point in its cure that it no longer flows. The voids adjacent to the shims 16 are then back filled with silicone rubber compound 17.

The cure and post cure of the silicone rubber compound 17 is then performed in accordance with the following procedure. The post cure procedure is necessary to condition the silicone rubber compound 17 for high temperature performance.

The silicone rubber compound 17 is then allowed to cure for four hours, minimum, at room temperature followed by curing for two hours, minimum, at 160°±10± F. The temperature is then raised to 260°±10° F. and held for 30 minutes, minimum. The temperature is then raised to 360°±10° F. and held for 30minutes, minimum. The temperature is then raised to 400°±10° F. and held for 30minutes, minimum. The silicone rubber compound 17 is then cooled to room temperature and excess RTV is cleaned from the assembly.

The cured silicone rubber compound 17 has several functions including keeping the dome 12 in position with minimal surface deformation, providing environmental sealing, and providing cushioning for the sapphire dome 12 during high speed flight of the missile 10, by reducing contact stress with the titanium turret 14 to a minimum.

A prototype dome structure was constructed in accordance with the above design by the assignee of the present invention. The potted sapphire dome 12 was tested using a Zygo interferometer. Test results indicate that maximum differential wavefront deformation of the sapphire dome 12, before the silicone rubber compound 17 was subjected to full cure and post cure, was two fringes of irregularity in a one inch diameter. An additional one fringe of wavefront deformation resulted from the installation process for the silicone rubber compound 17.

Therefore, the total differential wavefront deformation for the sapphire dome 12 at free state and after mounting to the titanium nose is three fringes of irregularity over a one inch diameter. This is equivalent to a deformation of 75 microinches over a one inch diameter of the dome 12. The dome 12 mount design thus meets the optical and mechanical performance requirements of the missile 10.

Thus, a missile having an improved stress-free dome mounting arrangement and method of attaching the dome to the missile have been disclosed. It is to be understood that the described embodiment is merely illustrative of some of the many specific embodiments which represent applications of the principles of the present invention. Clearly, numerous and varied other arrangements may be readily devised by those skilled in the art without departing from the scope of the invention.

What is claimed is:

1. An improved missile assembly comprising:

a body;

a nose portion disposed at a forward end of the body;

a dome mounting arrangement coupled to the nose portion that comprises:

a turret having an outer wall and an end surface, said turret being secured to the nose portion of the body of the missile;

a sapphire dome having an outer wall and an end surface; said end surface of said dome being in confronting relationship with said end surface of said turret;

a retainer ring having a first end portion attached to said turret and a second, opposite end portion spaced from said turret and extending beyond said turret, said retainer ring having an inner wall extending between said first and opposite end portions, whereby said inner wall of said retainer ring, said outer wall of said turret and said outer wall of said dome form an annular gap between said retainer ring and said turret and between said retainer ring and said sapphire dome when positioned adjacent said turret; and sealing material disposed within and filling said annular gap for joining said sapphire dome to said retainer ring.

2. The missile assembly of claim 1 wherein an axial gap joins said annular gap and extends between said confronting end surfaces of said sapphire dome and said turret for receiving sealing material from within said annular gap, thereby joining said sapphire dome to said turret while simultaneously cushioning said sapphire dome during high speed flight of said missile assembly.

3. The missile assembly of claim 1 wherein the retainer ring and turret are comprised of titanium.

4. The missile assembly of claim 1 wherein the retainer ring is attached to the turret by electron beam welding.

5. The missile assembly of claim 1 wherein the retainer ring is attached to the turret by using a threaded mechanical attachment.

6. The missile assembly of claim 1 wherein the retainer ring is bonded to the turret using an adhesive.

7. The missile assembly of claim 6 wherein the adhesive comprises a high temperature structural polyimide adhesive.

8. A dome mounting arrangement for use with a missile assembly of the type having a body with a nose portion disposed at a forward end of the body, said dome mounting arrangement comprising:

a turret having an outer wall and an end surface, said turret being secured to the nose portion of the body;

a sapphire dome having an outer wall and an end surface; said end surface of said dome being in confronting relationship with said end surface of said turret;

a retainer ring having a first end portion permanently attached to said turret and having a second, opposite end portion spaced from and extending beyond said turret, said retainer ring having an inner wall extending between said first and second, opposite end portions, whereby said inner wall of said retainer ring, said outer wall of said turret and said outer wall of said dome form both an annular gap between said retainer ring and said turret and between said retainer ring and said sapphire dome and a joint axial gap extending between said confronting end surfaces of said sapphire dome and said turret; and a silicone rubber compound disposed in both said annular and axial gaps for joining said sapphire dome to both said turret and said retainer ring while simultaneously cushioning said sapphire dome during high speed flight.

9. The dome mounting arrangement of claim 8 wherein the retainer ring and turret are comprised of titanium.

10. The dome mounting arrangement of claim 8 wherein the retainer ring is attached to the turret by electron beam welding.

11. The dome mounting arrangement of claim 8 wherein the retainer ring is attached to the turret by using a threaded mechanical attachment.

12. The dome mounting arrangement of claim 8 wherein the retainer ring is bonded to the turret using an adhesive.

13. The dome mounting arrangement of claim 12 wherein the adhesive comprises a high temperature structural polyimide adhesive.

* * * * *